US005155533A

United States Patent [19]

Kurokawa et al.

[11] Patent Number: 5,155,533

[45] Date of Patent: Oct. 13, 1992

[54] BIAS APPLICATION CONTROL DEVICE FOR IMAGE FORMING EQUIPMENT

[75] Inventors: Junji Kurokawa, Yokohama; Tsukasa Adachi, Tokyo; Hiromi Demizu, Yokohama, all of Japan

[73] Assignee: Ricoh Company, Ltd., Tokyo, Japan

[21] Appl. No.: 561,571

[22] Filed: Aug. 2, 1990

[30] Foreign Application Priority Data

| | | | |
|---|---|---|---|
| Aug. 3, 1989 | [JP] | Japan | 1-90980[U] |
| Sep. 4, 1989 | [JP] | Japan | 1-228891 |
| Oct. 26, 1989 | [JP] | Japan | 1-277038 |
| Jun. 27, 1990 | [JP] | Japan | 2-166809 |

[51] Int. Cl.[5] ..... G03G 21/00

[52] U.S. Cl. ..... 355/246; 355/216; 355/218

[58] Field of Search ..... 355/208, 219, 246, 251, 355/261, 218, 214, 216

[56] References Cited

U.S. PATENT DOCUMENTS 4,959,687 9/1990 Katoh et al. ..... 355/246 X

FOREIGN PATENT DOCUMENTS 0182472 10/1984 Japan .
0238070 10/1986 Japan ..... 355/246
0055575 3/1988 Japan ..... 355/246

*Primary Examiner*—A. T. Grimley
*Assistant Examiner*—J. E. Barlow, Jr.
*Attorney, Agent, or Firm*—Oblon, Spivak, McClelland, Maier & Neustadt

[57] ABSTRACT

A device for controlling the application of a bias for development in electrophotographic image forming equipment which forms a latent image on a photoconductive element and develops it by a magnetic brush formed by a dry two-component developer on a developing sleeve to which the bias is applied. A detector is located between the optics and the developing unit for detecting the passage of opposite ends of a charged area of the photoconductive element one by one. The bias is turned on and then turned off, each later than the detection of a particular edge of the charged area by a period of time in which the edge travels from a sensing position to a developing position. The bias applied to the developing sleeve is turned on at the time when the leading edge of the actually charged area of the photoconductive element arrives at the developing position, and it is turned off at the time when the trailing edge of such an area passes the developing position. Voltage is applied to the developing sleeve stepwise such that at least one of the rise and fall of the bias potential occurs in two or more steps.

1 Claim, 8 Drawing Sheets

BIAS APPLICATION CONTROL DEVICE FOR IMAGE FORMING EQUIPMENT

BACKGROUND OF THE INVENTION

The present invention relates to electrophotographic image forming equipment for forming a latent image on a photoconductive element and developing it by a magnetic brush of dry two-component developer formed on a developing sleeve to which a bias for development is applied. More particularly, the present invention is concerned with a device for controlling the application of the bias to the developing sleeve.

Generally, in electrophotographic image forming equipment such as an electrophotographic copier, laser beam printer or facsimile machine, a latent image is electrostatically formed on the surface of a photoconductive element or image carrier and developed by a dry two-component developer which is a mixture of toner and is carrier particles. The developer is magnetically deposited on a developing roller or a developing sleeve to form a magnetic brush. It is a common practice with this kind of development to apply a bias for development to the developing roller or the developing sleeve. In an electrophotographic copier, for example, a motor for rotating the photoconductive element is energized on the operation of pressing copy button. Then, a charging unit for charging the surface of the photoconductive element and a bias power source are sequentially turned on in this order. As a result, the bias is applied to the developing roller or the developing sleeve, whereupon a predetermined copying operation begins. On the completion of the copying operation, the charging unit, bias power source and motor are sequentially turned off.

However, starting on a copying operation at the above-stated timing causes the carrier to deposit on a part of the photoconductive element coresponding to a leading or a trailing edge portion of a paper sheet in a several millimeters wide stripe configuration which extends crosswise on the element, as proved by experiments. Although the carrier so deposited on the photoconductive element does not directly effect the image transferred to a paper sheet, it is in due course scattered around in the copier to contaminate the latter. It is therefore necessary to prevent the carrier from depositing on the non-image area of the photoconductive element.

SUMMARY OF THE INVENTION

It is therefore an object of the present invention to provide a bias application control device for image forming equipment which eliminates the deposition of a carrier on the non-image area of a photoconductive element or image carrier as well as the wasteful deposition of toner thereon.

It is another object of the present invention to provide a generally improved bias application control device for image forming equipment.

In image forming equipment having a rotary photoconductive element, a charging unit for charging the photoconductive element, optics for illuminating a charged area of the photoconductive element imagewise to form a latent image, and a developing unit for developing the latent image by a magnetic brush which is formed on a developing sleeve, to which the bias is applied by a dry two-component developer. The charging unit, optics and developing unit are arranged around the photoconductive element. A bias application control device is utilized in the present invention and comprises a detector located between the optics and the developing unit for detecting the passage of opposite edges of the charged area of the photoconductive element one by one. A control is also provided for turning on and turning off the bias applied to the developing sleeve, each on the lapse of a predetermined period of time in which respective one of the edges of the charged area travels from a detecting position to a developing position.

Also in a device for controlling application of a bias for development in image forming equipment having a rotary photoconductive element, a charging unit for charging the photoconductive element, optics for illuminating a charged area of the photoconductive element imagewise to form a latent image, and a developing unit for developing the latent image by a magnetic brush which is formed on a developing sleeve, to which the bias is applied, by a dry two-component developer, the charging unit, optics and developing unit are arranged around the photoconductive element. In accordance with the present invention, a turn-on and a turn-off of the bias are delayed by respective predetermined periods of time relative to a turn-on and a turn-off timing of the charging unit. The predetermined periods of delay time each is selected to correspond to a width of a charging range as measured on the photoconductive element in an intended direction of movement of the photoconductive element.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
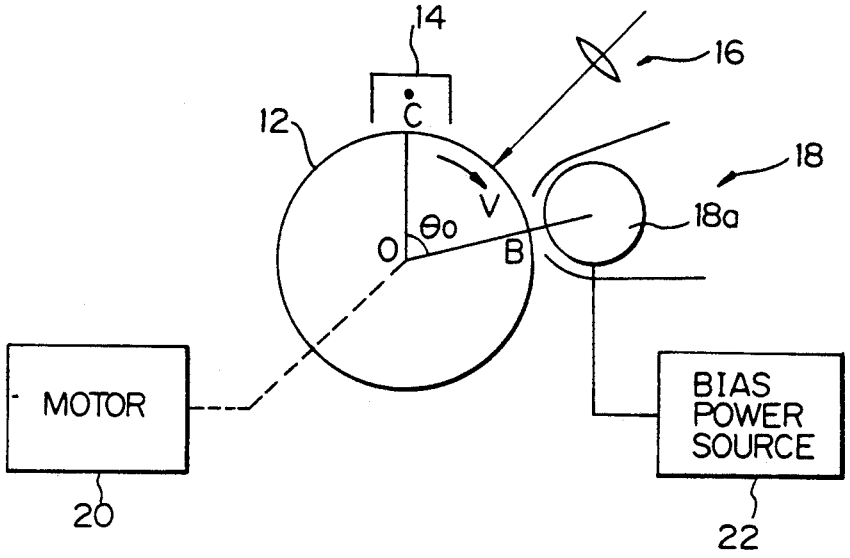
Fig. 1 PRIOR ART
FIG. 1 is Prior Art, schematically showing an electrophotographic copier belonging to a family of image forming equipment and having an electrophotographic element in the form of a drum.

To better understand the present invention, a brief reference will be made to conventional image forming equipment, shown in FIG. 1. Implemented as an electrophotographic copier by way of example, the image forming equipment has a photoconductive element in the form of a drum 12. Arranged around the drum 12 are a charging unit 14, optics 16 for imagewise exposure, and a developing unit 18 having a developing sleeve 18*a*. The drum 12 is driven by a motor 20. A bias power source 22 applies a bias for development to the developing sleeve 18*a*.

Figure 2:
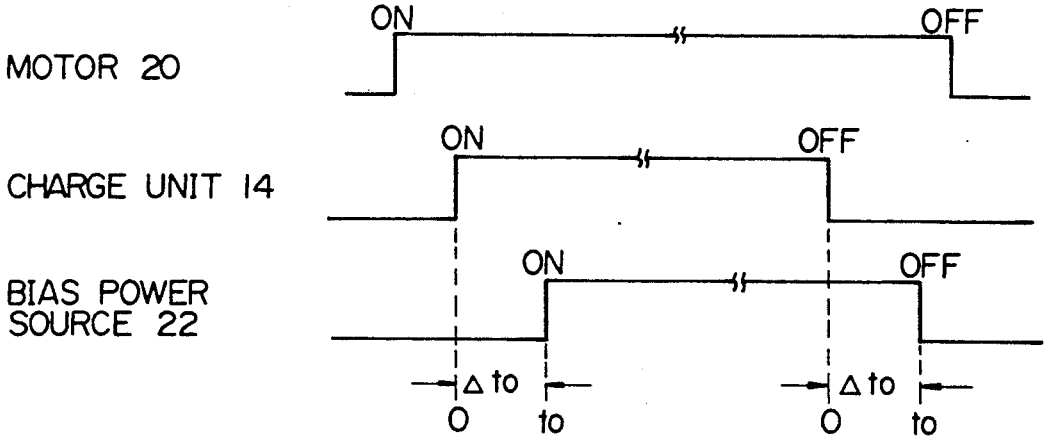
Fig. 2 PRIOR ART
FIG. 2 is Prior Art and shows a timing chart representative of operations of various units included in the copier of FIG. 1.

FIG. 2 shows a relation of the motor 20, bias power source 22, and charging unit 14 to one another with respect to the on/off timings. As shown, when a copy button, not shown, is pressed, the motor 20 is turned on to start rotating the drum 12. Next, the charging unit 14 is turned on and, on the lapse of a period of time $\Delta t_o$, the bias power source 22 is turned on. Then, a copying operation begins. As soon as a desired number of copies are produced, the charging unit 14 is turned off and, on the lapse of the period of time $\Delta t_o$, the bias power source 22 is turned off. Finally, the motor 20 is turned off to stop rotating the drum 12. The interval $\Delta t_o$ between the turn-on (turn-off) of the charging unit 14 and the turn-on (turn-off) of the bias power source 22 is expressed as:

$$\Delta t_0 = \frac{d_0 \times 3.14 \times \theta_0/360}{v} \quad (1)$$

where $d_o$ is the diameter (millimeter) of the drum 12, v is the linear velocity of the drum 12 (millimeter per second), and $\theta_o$ is, as shown in FIG. 1, the angle (degree) between lines CO and BO interconnecting respectively the center O of the drum 12 and the charging unit 14 and developing sleeve 18*a*.

The problem with the above relation is that a carrier deposits crosswise on the drum 12 in a several millimeter wide stripe configuration in positions which correspond to the leading and trailing edge portions of a paper sheet or copy, as confirmed by experiments. Extended studies and experiments revealed the following facts.

Figure 3:
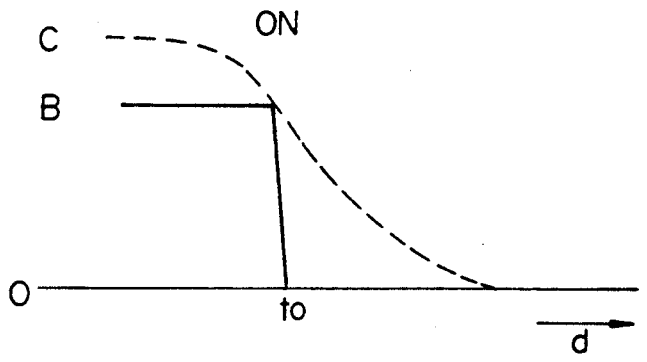
FIGS. 3 and 4 show respectively conventional turn-on and turn-off characteristics of a bias for development.
Figure 4:
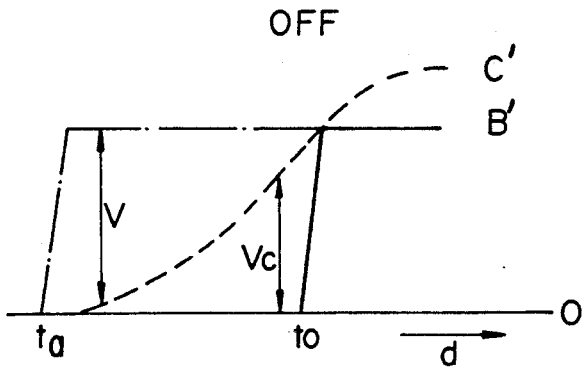

FIG. 3 shows how the leading edge of the charged area of the drum 12 approaches a developing position at the velocity v (dashed line C indicating the rise of the charge potential). The abscissa, or arrow d, indicates the direction in which the drum 12 rotates, or advances, at the linear velocity v. As shown, when the bias (line B) is applied at a time $t_o$, a carrier deposits on the drum 12 since the application is a little bit late. FIG. 4 shows a condition wherein the trailing edge of the charged portion of the drum 12 passes the developing position at the velocity v (dashed line C' indicating the fall of the charge potential). Turning off the bias at a time $t_o$ (line B') is too early and causes the carrier to deposit on the drum 12 at a carrier deposition potential Vc (B'−C'). If the bias is turned off at a time $t_a$ which is later than $t_0$, the toner would deposit on the drum 12 at a toner deposition potential Vt (B'−C') in a several meters wide stripe configuration.

Preferred embodiments of the present invention which are free from the above problem will be described hereinafter.

First Embodiment

Figure 5:
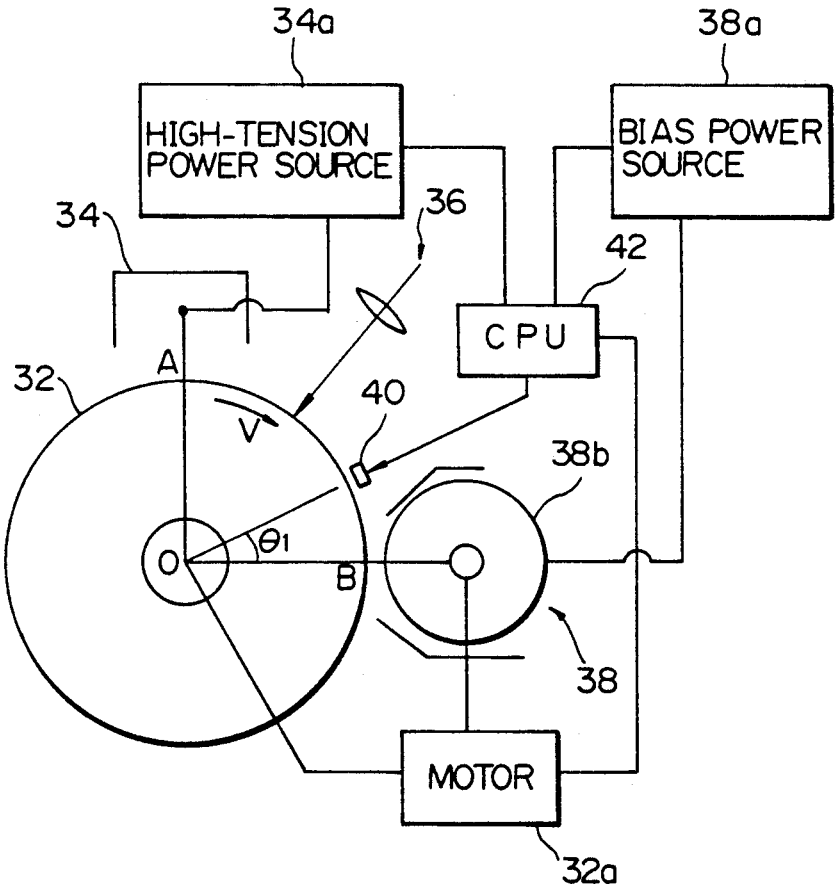
FIG. 5 is a schematic block diagram showing a first embodiment of the control device in accordance with the present invention.

Referring to FIG. 5, image forming equipment to which a first embodiment of the present invention is applied has a photoconductive drum 32, a motor 32*a* for driving the drum 32, a charging unit 34, optics 36, and a developing unit 38 having a developing sleeve 38*b*. The charging unit 34 is connected to a high-tension power source 34*a* for charging the drum 32. The optics 36 illuminates the charged area of the drum 32. The developing unit 38 is connected to a bias power source 38*a* for developing the illuminated area of the drum 32.

In the illustrative embodiment, surface potential detector 40 or similar detecting means is located at a position C intermediate between the optics 36 and the developing unit 38 for detecting the passage of opposite edges of the charged area of the drum 32 one at a time, as will be described. Control means in the form of a CPU 42, for example, turns on and then turns off the bias from the power source 38*a* at times later than the associated times when the surface potential detector 40 has detected the edges one by one, each by a period of time in which the edge travels from the detecting position or intermediate position C to the developing position B. Specifically, the surface potential detector 40 detects the rise of the surface potential of the drum 32 which is indicated by a dashed line in FIG. 6, i.e., the passage of the leading edge of the charged area of the drum 32. Then, the CPU 42 turns on the bias on the lapse of a period of time (tB−tC) in which the leading edge of the charged area advances from the intermediate position C to the developing position B. Assume that the linear velocity of the drum 32 is V, the radius of the drum 32 is r, and the angle between lines CO and BO interconnecting respectively the center O of the drum 32 and the intermediate position C and developing position B is $\theta_1$. Then, the delay time (tB−tC) is set as follows:

$$tB - tC = 2\pi r \times (\theta_1/360)/V \quad (2)$$

Figure 6:
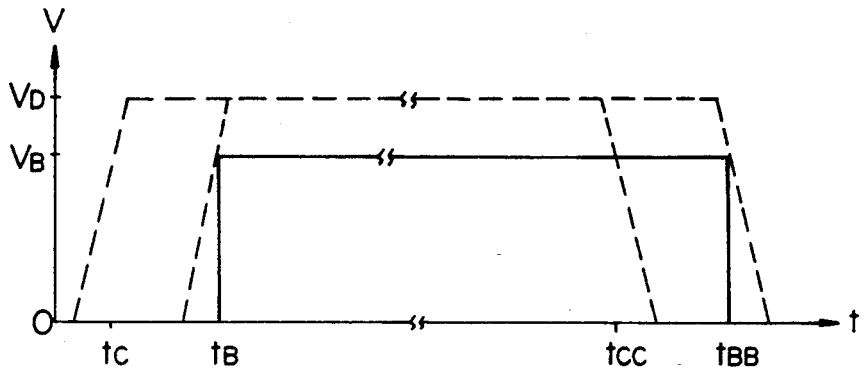
FIG. 6 is a graph showing a relation between the surface potential of a photoconductive element and a bias potential.

When the developing unit 38 completes its image forming operation, the surface potential detector 40 detects the fall of the surface potential of the drum 32 which is indicated by a dashed line in FIG. 6, i.e., the passage of the trailing edge of the charged area of the drum 32. In response, the CPU 42 turns off the bias on the lapse of a period of time (tBB−tCC) in which the trailing edge advances from the intermediate position to the developing position B. Subsequently, the developing unit 38 and the drum drive motor 32*a* are deactivated.

With the illustrative embodiment described above, it is possible to turn on and turn off the bias voltage at appropriate timings when the opposite edges of the charged area of the drum 32 pass the developing position B one after another.

Figure 7:
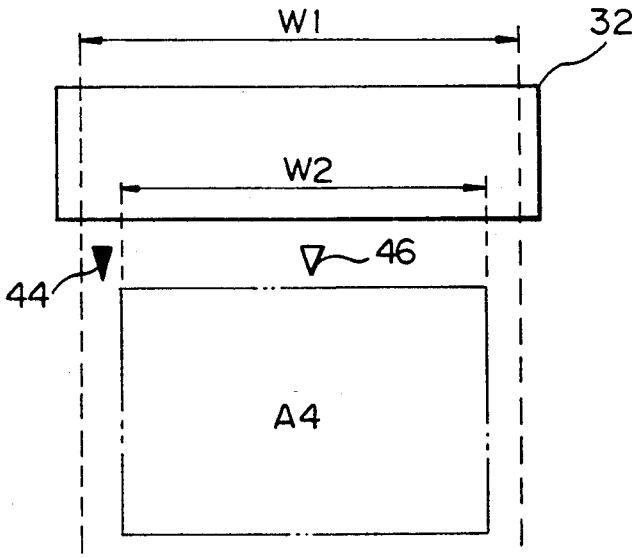
FIG. 7 is a plan view of a photoconductive element, showing positions where a detector may be located.

As shown in FIG. 7, the detector 40 should preferably be positioned within the chargeable width W1 of the drum 32 and outside of either one of opposite ends of the image writing width W2, as represented by the reference numeral 44. It is to be noted that the detector 40 may be located at the center of the drum 32 when it also functions as an electrometer for process control purposes, as represented by the reference numeral 46.

Second Embodiment

Figure 8:
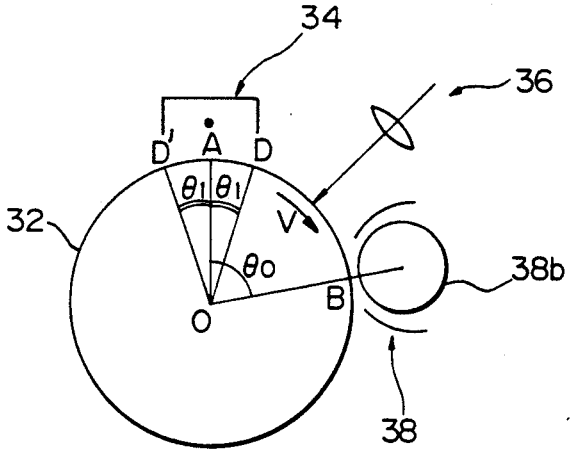
FIG. 8 is a schematic view showing a second embodiment of the present invention.

FIG. 8 shows image forming equipment with which an alternative embodiment of the present invention is practicable. In the figures, similar components are designated by like reference numerals, and a redundant description thereof will be avoided for simplicity. As shown, assume that the line interconnecting the center O of the drum 32 and a reference position A corresponding to the center of the charging unit 34 is the reference line. Then, the lines interconnecting respectively the center O of the drum 32 and the preceding and succeeding boundary points D and D' of the chargeable area covered by the charging unit 34 have the same angle $\theta_1$ (degrees) to the reference line. The line interconnecting the center O of the drum 32 and the center B of the developing sleeve B is inclined by an angle $\theta_0$ (degrees) to the reference line. The drum 32 has a diameter $d_0$ (millimeter) and is moved at a linear velocity V (millimeter per second). In the above conditions, the interval $\Delta t_0$ between the turn-on of the charging unit 34 and the arrival of the reference position A of the drum 32 corresponding to the center of the charging unit 34 at the developing position B is produced by:

$$\Delta t_0 = \frac{d_0 \times 3.14 \times (\theta_0/360)}{V} \quad (3)$$

The interval $\Delta t_1$ between the turn-on of the charging unit 34 and the arrival of the leading edge D of the actually charged area of the drum 32 at the developing position B is expressed as:

$$\Delta t_1 = \frac{d_0 \times 3.14 \times [(\theta_0 - \theta_1)/360]}{V} \quad (4)$$

Further, the interval $\Delta t_2$ between the turn-off of the charging unit 34 and the passage of the trailing edge D' of the actually charged area clear of the developing position B is produced by:

$$\Delta t_2 = \frac{d_0 \times 3.14 \times [(\theta_0 + \theta_1)/360]}{V} \quad (5)$$

Figure 9:
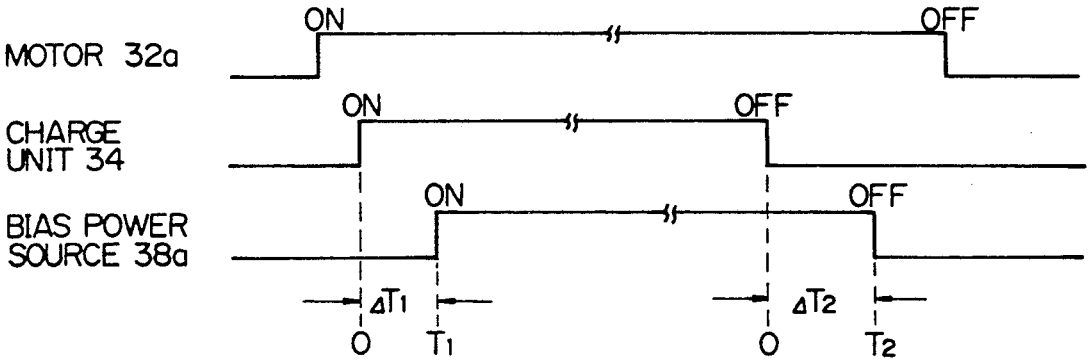
FIG. 9 is a timing chart demonstrating the operations of various units included in the embodiment of FIG. 8.

In this instance, the bias applied to the developing unit 38 is turned on and turned off at particular timings shown in FIG. 9. As shown, when the print button is pressed, the motor 32*a* is energized to start rotating the drum 32 and developing sleeve 38*b*. The charging unit 34 is turned on the lapse of a predetermined period of time from the turn-on of the motor 32*a*. Then, on the lapse of a period of time $\Delta T_1$, the bias power source 38*a* is turned on. The period of time $\Delta T_1$ is selected to be shorter than, or expires before, the previously mentioned period of time $\Delta t_0$ in which the drum reference position A corresponding to the center of the charging unit 34 arrives at the developing position B, and longer than, or expires after, the period of time $\Delta t_1$ in which the leading edge D of the actually charged portion arrives at the developing position B. Namely, there holds a relation:

$$\Delta t_1 < \Delta T_1 < \Delta t_0 \quad (6)$$

Stated another way, the bias is applied to the developing sleeve 38*a* earlier than the conventional timing. More specifically, the bias power source 38*a* is turned on the lapse of 0.36 second ($=\Delta T_1$) since the turn-on of the charging unit 34.

As soon as the printing operation is repeated to produce a desired number of copies, the charging unit 34 and bias power source 38*a* are sequentially turned off in this order. The turn-off of the bias power source 38*a* occurs $\Delta T_2$ later than the turn-off of the charging unit 34. This delay time $\Delta T_2$ is selected to be longer than, or expires after, the period of time $\Delta t_0$ in which the reference position A of the drum 32 arrives at the developing position B, and shorter than, or expires before, the period of time $\Delta T_2$ in which the trailing edge D' of the actually charged area passes the developing position B. Namely, there holds a relation:

$$\Delta t_0 < \Delta T_2 < \Delta t_2 \quad (7)$$

Specifically, the bias power source 38*a* is turned off on the lapse of 0.44 second ($=\Delta T_2$) since the turn-off of the charging unit 34.

At the end of the above-stated procedure, the drum 34 and developing sleeve 38*b* are brought to a stop.

The specific periods of time, i.e., 0.36 second ($\Delta T_1$) and 0.44 second ($\Delta T_2$) mentioned above satisfy respectively the relations (6) and (7). In the illustrative embodiment, $\Delta t_0 = 0.4$ second
$\theta_1 = 14$ degrees
$\Delta t_1 = 0.335$ second
$\Delta t_2 = 0.465$ second Hence, $$0.335 < 0.36\ (\Delta T_1)$$

$$0.4 < 0.44\ (\Delta T_2) < 0.465$$

As described above, in this embodiment, the bias for development is turned on not at the time when the reference position A of the drum 32 that corresponds to the center of the charging unit 34 reaches the developing position B, but at the time when the leading edge D of the actually charged area arrives at the position B. Also, the bias is turned off not at the time when the reference position A of the drum 32 passes the developing position B, but at the time when the trailing edge D' of the actually charged area passes the position B. Turning on and turning off the bias at such timings is successful in eliminating the deposition of a carrier and, therefore, wasteful developer consumption and in precluding contamination due to the scattering of the developer.

For comparison, when the periods of time $\Delta T_1$ and $\Delta T_2$ were selected to be 0.3 second and 0.5 second, respectively, a toner was deposited on a single printing crossways in a stripe configuration. When the printing operation was repeated to produce about 10,000 printings, 1.3 times greater amount of toner was consumed than with the illustrative embodiment and the contamination was critical.

In this embodiment, the bias for development is switched from zero volt to −600 volts in the event of turn-on and from −600 volts to zero volt in the event of turn-off. It is to be noted that the words "turn-on" and "turn-off" refer to, respectively, the changes which decrease and increase the potential difference between the bias potential and the drum surface potential. For example, assuming that the surface potential of the drum 32 is −800 volts, then the change of the bias from +100 volts to −550 volts and the change thereof from −550 volts to −100 volts are the "turn-on" and the "turn-off", respectively.

Third Embodiment

Figure 10:
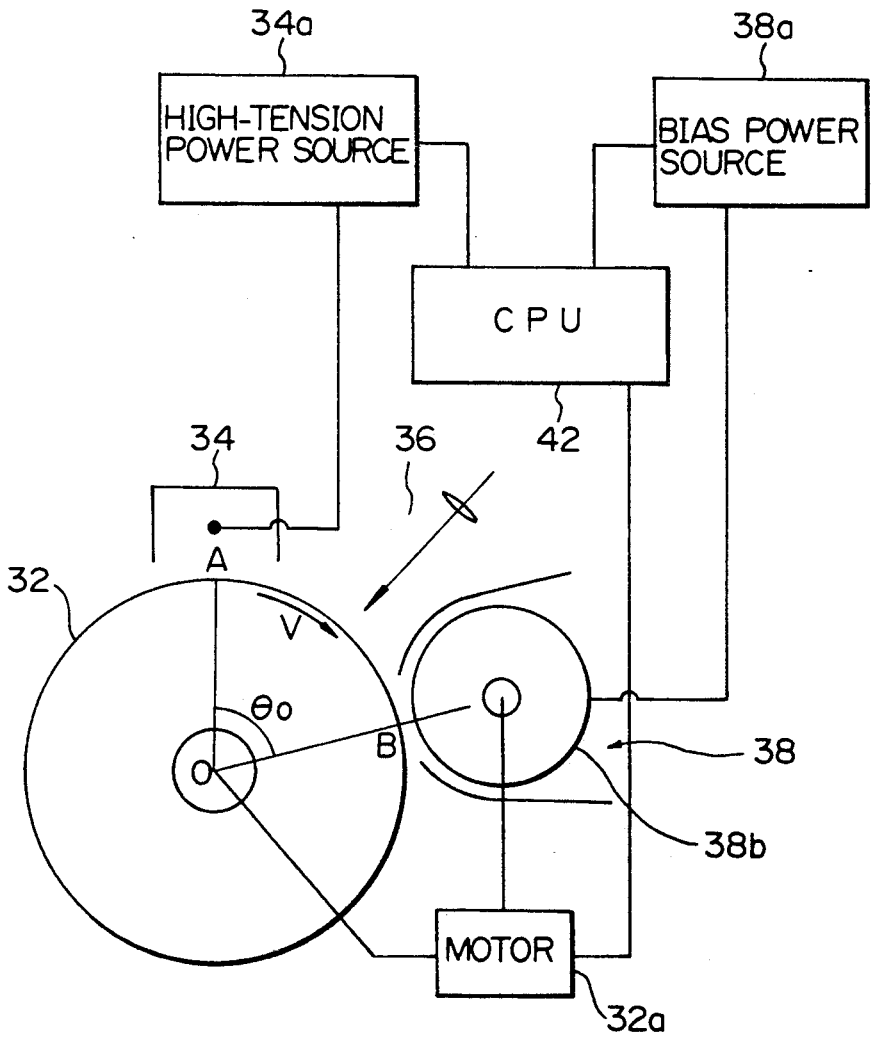
FIG. 10 is a schematic block diagram showing a third embodiment of the present invention.

Referring to FIG. 10, another alternative embodiment of the present invention is shown. Image forming equipment for practicing this embodiment is constructed and arranged in the same manner as in the second embodiment. In the figures, similar components are designated by like reference numerals, and a redundant description there of will be avoided for simplicity. In this particular embodiment, the CPU 42 controls the application of the bias to the developing sleeve, as follows.

Figure 11:
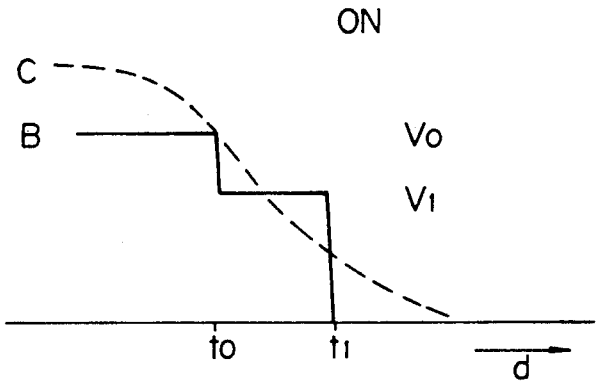
FIGS. 11 and 12 show respectively turn-on and turn-off characteristics of a bias potential particular to the embodiment of FIG. 10.
Figure 12:
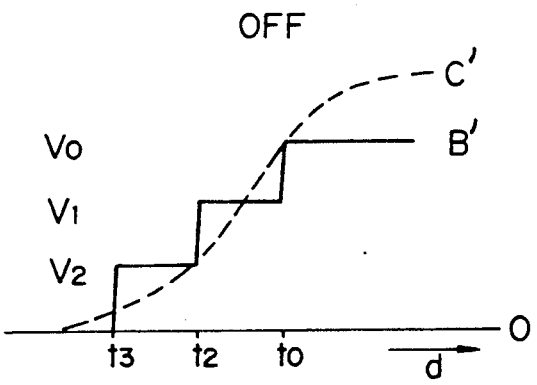

FIGS. 11 and 12 show respectively the characteristics associated with the turn-on and turn-off of the bias particular to this embodiment. As FIGS. 11 and 12 indicate, when the bias is varied stepwise as represented by $V_1$ and $V_0$, FIG. 11, or by $V_0$, $V_1$ and $V_2$, FIG. 12, the difference $|B-C|$ or $|B'-C'|$ between the surface potential of the drum 32 (dashed line C or C') and the bias potential (line B or B') is maintained small at any time to thereby eliminate the deposition of toner and carrier on the drum 32.

Figure 13:
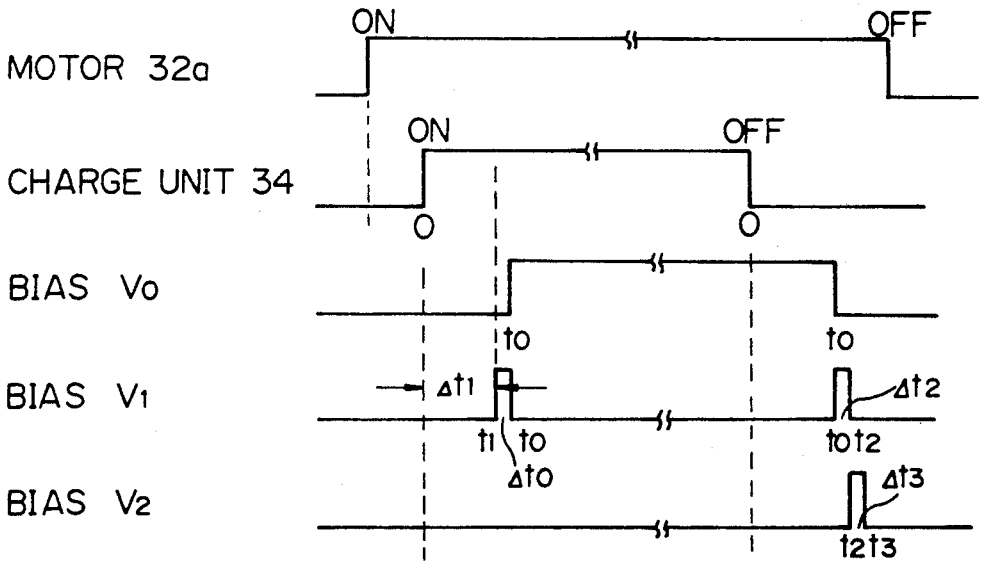
FIG. 13 is a timing chart representative of the operations of various units included in the third embodiment.

FIG. 13 is a timing chart representative of the operation of the illustrative embodiment. The turn-on and turn-off of the motor 32*a*, charging unit 34, and the bias $V_0$, $V_1$ and $V_2$ are effected at particular timings which are determined by the CPU 42, FIG. 10. Specifically, when the print button is pressed, the motor 32*a* is turned on to rotate the drum 32 at a linear velocity of V millimeter per second. Then, the charging unit 34 is turned on (time 0). On the lapse of a period of time $\Delta t_1$ (time $t_1$), the bias power source 38*a* is turned on to raise the bias $V_1$ and, $\Delta t_0$ later (time $t_0$), the bias $V_1$ falls while the bias $V_0$ rises. As the optics 36 completes imagewise exposure, the charging unit 34 is turned off (time 0). Then, on the lapse of a period of time $\Delta t_0$ (time $t_0$), the bias $V_0$ falls and, instead, the bias $V_1$ rises. Further, on the lapse of a period of time $\Delta t_2$ (at time $t_2$), the bias $V_1$ falls and, instead, the bias $V_2$ rises. Finally, $\Delta t_3$ later (time $t_3$), the bias $V_2$ falls.

By turning on and turning off the bias voltages in such a manner as to approximate them to the rise and fall of the charge potential as stated above, it is possible to eliminate the deposition of needless carrier and toner particles.

The illustrative embodiment will be described more specifically in relation to a laser beam printer in which the drum 32 has a diameter of 80 millimeters and moves at a linear velocity of 150 millimeters per second, the charging unit 34 has a charging voltage of about −800 volts, and use is made of a dry two-component developer which forms a magnetic brush (non-charged toner; bias voltage of −600 volts).

First, as the print button is pressed, the drum 32 (and developing sleeve 38*b*) starts rotating, and this is followed by charging and imagewise exposure. On the lapse of 0.35 second (time 0.35 second) since the turn-on of the charging unit 34 (time 0), the bias is raised to −400 volts and, on the lapse of 0.05 second (time 0.40 second), the bias is further increased to −600 volts to develop a latent image having been formed on the drum 32. When a predetermined number of printings have been produced, the bias is lowered from −600 volts to −400 volts on the lapse of 0.45 second (time 0.40 second) as counted from the turn-off of the charging unit 34 (time 0). Further, when 0.45 second expires (time 0.45 second), the bias of −400 volts is turned off. Finally, the drum 32 (and developing sleeve 38*a*) is brought to a stop.

Experiments showed that when the turn-on and turn-off of the bias voltages are effected stepwise at the above timings, the difference between the surface potential of drum 32 and the bias potential is smaller than 200 volts in absolute value at any time, preventing a carrier from depositing on the drum 32 and allowing a minimum of toner deposition to occur.

In the above specific condition, the equation (1) is rewritten as:

$$\Delta t_0 = \frac{80\text{ mm} \times 3.14 \times (86°/360°)}{150\text{ mm/sec}} \qquad (1)'$$

Assume that a paper sheet traveling at the same speed as the linear velocity of V millimeter per second of the drum 32 has jammed the transport path. Then, with a prior art laser printer, it has been customary to turn off a drum drive motor, charging unit, and bias power source at the same time in response to a paper jam output. This would cause the carrier to deposit on the surface of the drum 32 which is located at the developing position. In contrast, this embodiment turns off the charging unit 34 in response to a paper jam output, then turns off the bias power source 38*a* on the lapse of a period of time $\Delta t_0+\Delta t_2+\Delta t_3$, and then deenergizes the motor 32*a* to thereby stop the rotation of the drum 32 (see FIG. 13). Hence, the illustrative embodiment prevents carrier particles from depositing on the drum 32 even when a paper jam occurs.

In summary, it will be seen that the present invention causes a bias for development to rise accurately at the time when the leading edge of the charged area of a photoconductive element passes a developing position and causes it to fall accurately at the time when the trailing edge of the same passes the developing position. This frees the photoconductive element from contamination ascribable to toner and carrier particles.

In accordance with the present invention, the bias is turned on and turned off at such timings that the bias rises and falls in association with the actually charged area of the photoconductive element. Hence, the deposition of a toner on marginal areas of the drum and also the deposition of a carrier are eliminated, promoting high quality image formation. Especially, in the event of a paper jam, the present invention does not turn off the charging and bias at the same time and thereby surely prevents a carrier from depositing on the surface of the element.

Further, in accordance with the present invention, the bias voltage is raised and lowered stepwise so that the difference between the potential of the photoconductive element and that of the bias is maintained smaller than a predetermined value in absolute value. This eliminates the deposition of needless carrier and toner particles on the element.

Various modifications will become possible for those skilled in the art after receiving the teachings of the present disclosure without departing from the scope thereof.

What is claimed is:

1. A device for controlling an application of a bias for development in image forming equipment, comprising:

a rotary photoconductive element;

a charging unit for charging said rotary photoconductive element to generate a charged area;

optics for illuminating said charged area of said photoconductive element imagewise to form a latent image thereon;

a developing unit for developing said latent image by a magnetic brush which is formed on a developing sleeve, to which said bias is applied, by a dry two-component developer, wherein said charging unit, said optics and said developing unit are arranged around said photoconductive element;

control means for controlling a turn-on and a turn-off of the bias to be delayed by respective predetermined periods of time relative to a turn-on and a turn-off timing of the charging unit, wherein an interval between the turn-off of the charging unit and the turn-off of the bias is longer than an interval between the turn-on of the charging unit and the turn-on of the bias;

wherein said control means applies a voltage stepwise to the developing sleeve such that the bias has at least two stepwise bias potentials in the event of at least one of turn-on and turn-off, such that the bias voltage is sequentially raised or lowered within a range of a limited delay time.

* * * * *